United States Patent [19]

Block et al.

[11] 4,389,957

[45] Jun. 28, 1983

[54] BELT LOOP SETTING SYSTEM

[75] Inventors: Charles Block, North Bellmore; Leon Mintz, Syosset, both of N.Y.

[73] Assignee: Joseph Galkin Corporation, Hicksville, N.Y.

[21] Appl. No.: 206,790

[22] Filed: Nov. 14, 1980

[51] Int. Cl.[3] ..... D05B 3/12; D05B 23/00; D05B 97/00

[52] U.S. Cl. ..... 112/262.3; 112/121.27; 112/104; 112/265.1

[58] Field of Search ..... 112/121.27, 121.26, 112/121.15, 121.12, 104, 152, 262.3, 265.1

[56] References Cited

U.S. PATENT DOCUMENTS 3,792,672 2/1974 Friedman et al. ..... 112/152 X

*Primary Examiner*—H. Hampton Hunter

*Attorney, Agent, or Firm*—Paul J. Sutton

[57] ABSTRACT

The present invention teaches a system which, utilizing pneumatic logic, folds and positions pre-cut belt loop material for joinder to pants. The pre-cut material is loaded while joinder is occurring. Two pairs of upstanding pins supported by fingers receive individually cut belt loop fabric pieces which can be made from scrap to match colors and, in a preferred embodiment of this invention, two tacks secure the loop to pants in the case of jeans. A novel adjustable cam control arrangement and means for rotating the fingers is described in the following specification.

2 Claims, 18 Drawing Figures

FIG. 1
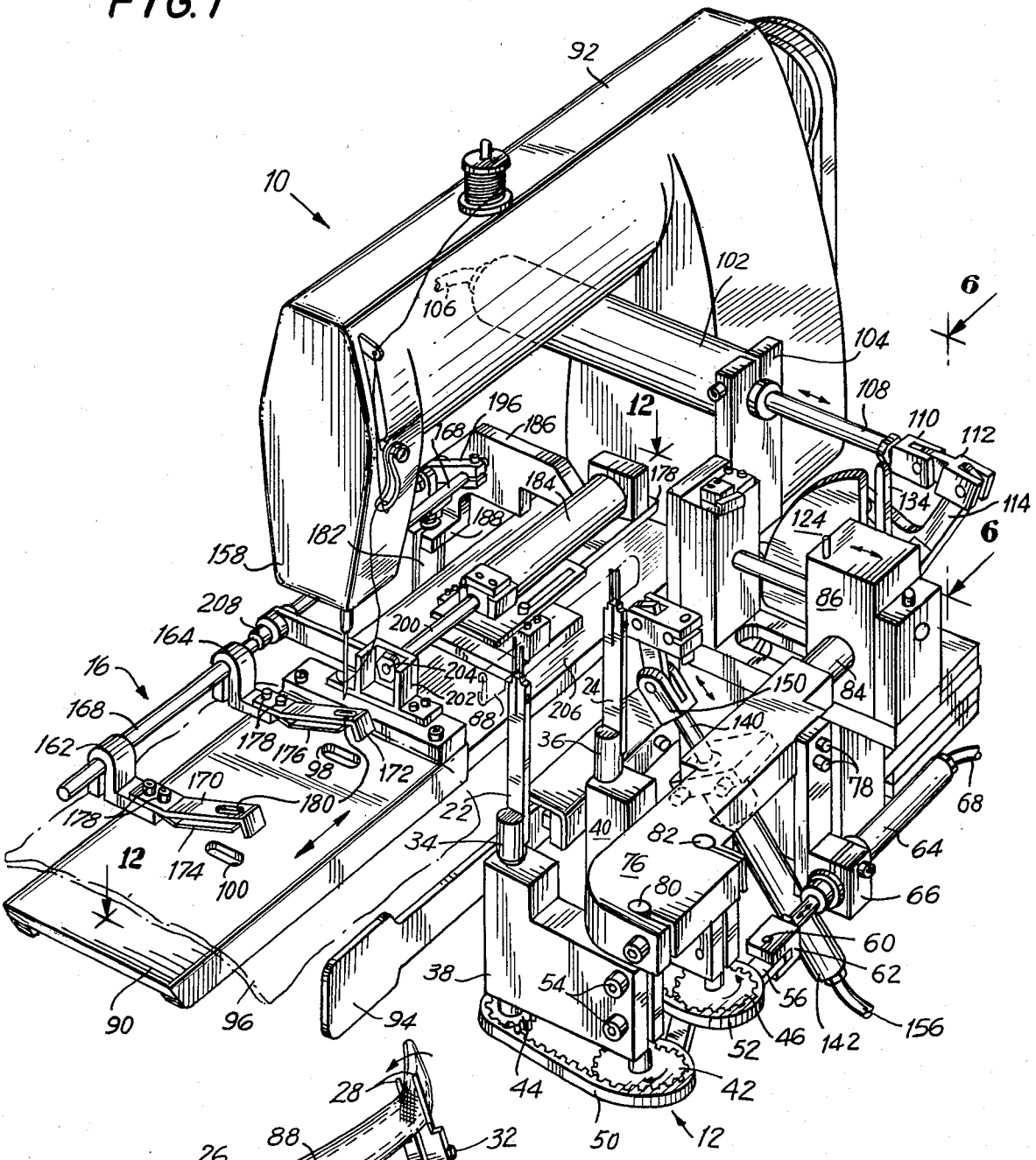
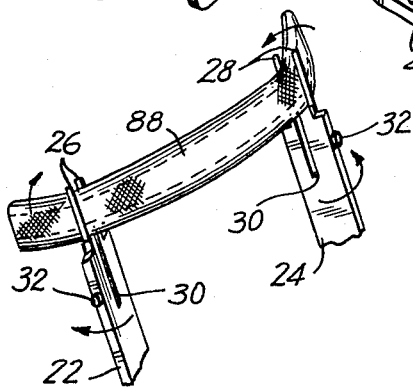
FIG. 1a 13
13
16
16
162
164
168
168
168
178
178
180
182
182
184
184
186
186
188
188
188
190
192
192
194
196
196
198
198
88
90
96

BELT LOOP SETTING SYSTEM

The present invention relates generally to sewing and joining machine attachments, and more particularly to a novel system, method and apparatus for automatically folding, positioning and tacking both ends of a belt loop on a trouser waistband.

A need exists for a sewing machine attachment system which is relatively inexpensive, reduces operator time, is reliable and efficient, and which operates semi-automatically in synchronization with its host sewing machine to repeatedly fold, position and tack belt loops on pants and jeans. A further need exists for a system, as described below, which will facilitate accomplishing these needs utilizing individually pre-cut pieces of fabric in the form of belt loop strips (commonly called "loops"), whose colors can be reliably and more accurately matched to the pants to which they are to be attached.

Belt loop attachment machines now exist, although they possess a number of drawbacks or disadvantages. In the spirit of making the U.S. Patent and Trademark Office aware of what we consider to be relevant known prior developments, a brief discussion of existing machines that are recalled at this time follows.

The Apparel Equipment Division of AMF, located in Richmond, Va., has published promotional literature describing an automatic belt loop machine. This relatively expensive machine, according to this literature, utilizes a continuous supply of belt loop material which is cut and folded and which supposedly automatically attaches belt loops to jean-style pants in a purportedly simple manner requiring relatively unskilled labor. Apart from this equipment appearing relatively complicated and being relatively expensive, we are not able to describe here the exact manner of operation except to say that, by virtue of utilizing continuously fed belt loop material, it cannot possibly operate in the manner of operation of the present invention and system.

Another manufacturer of machinery that has advertised a belt loop attaching machine is the Rochester Button Company, Apparel Equipment Division, of Atlanta, Ga. As in the case of the AMF machinery, the Rochester literature shows equipment which utilizes presewn belt loop material originally supplied from a roll or strip and, during an automatic cycle, the belt loop material that is precut from this continuous spool is folded and positioned on the pants for tacking. It is known that the Rochester company has attempted to utilize individual strips of presewn belt loop material, and all literature in the possession or control of applicants shall be made available to the Examiner of the U.S. Patent and Trademark Office, upon request. It is most respectfully urged that the present invention patentably distinguishes over each and all of this conventional equipment.

Yet another so-called automatic belt loop attaching machine for jeans has been publicized by Tokyo Juki Industrial Co., Ltd., a Tokyo based Japanese company which markets this equipment under the trademark "JUKI". As in the case of the AMF equipment, the Juki system apparently utilizes a roll of presewn belt loop material which is fed into a machine for attachment to heavyweight material such as denim for jeans.

Applicants further wish to bring to the attention of the U.S. Patent and Trademark Office the existence of their own U.S. Pat. Nos. 3,565,711 and 3,587,947, which, while not anticipatory of the present invention as claimed and described, will give the reader an appreciation of problems traditionally encountered in this art.

It is an object of the present invention to provide a belt loop setter and belt loop setting system for use with a conventional commercial sewing machine, or the like. Another object is to provide such a system which utilizes pneumatic logic in its operational controls, as opposed to a fluid hydraulic or electrical control system. In this regard, however, it is contemplated that the present invention may include alternate types of system controls other than the preferred embodiment that will be described hereinbelow.

A further object of this invention is to provide a belt loop setting system which is semi-automatic and which requires relatively short personnel training times and relatively unskilled labor to operate the system efficiently.

Yet another object of our invention is to provide such a system, wherein individual lengths of presewn belt loop material are color matched to apparel to which they are to be attached, and wherein a relatively small or short folding turnunder is accomplished utilizing the apparatus according to the present invention, whereby undesirable wasting of loop material and fraying of the ends of the belt loop material after washing is avoided or eliminated.

Yet a further object of this invention is to provide a belt loop setting system, as above, which is a fraction of the cost of conventional equipment that is believed to currently be on the market at prices which are relatively high to the purchaser and user. Our system has been designed to be reliable, giving repeated consistent results, as demonstrated experimentally at at least one trade show.

Still another object of our invention is to provide a belt loop setter and system which utilizes a cam control attachment with a modified feed bar and which, when operating according to its intended function, facilitates turnunders or bendunders of belt loop materials of approximately ¼ of an inch or less, thereby saving material as well as avoiding the fraying mentioned above.

A further object is to provide a system, as above, wherein a novel twirling pin/form or finger arrangement utilizes a non-circular rotation of the twirling pins which fold the belt loop material strip, thereby avoiding a frictional load on these twirling pins and further avoiding sliding of the belt loop material within the space between the pins. This novel arrangement during the forming creates and then eliminates slack in the strip of belt loop material to be sewn or attached to apparel, such as jeans.

It is difficult within a short and incomplete description of the several objects of the present invention to fully define the means by which the aforementioned objects are accomplished. Accordingly, this will become far more apparent from a reading of the following specification which is crossreferenced to the drawings, and wherein similar reference characters throughout the specification correspond to those depicted in the views of the attached drawings, wherein:

FIG. 1 is a fragmentary and partial perspective view of the system according to the present invention;

FIG. 1*a* is an enlarged fragmentary perspective view of two pair of pins according to the present invention in and between which a length of belt loop material is situated;

FIG. 2 is a simplified schematic-type fragmentary sectional elevational view of both the sewing station at which a stripper/clamp is situated, as well as what will be referred to here as an inserter which supports upstanding loop forming fingers or pins;

FIG. 2*a* is a view taken along the line 2*a*—2*a* of FIG. 2;

FIG. 2*b* is a view taken along the line 2*b*—2*b* of FIG. 2;

FIG. 3 is a view similar to FIG. 2 of the same sewing station and inserter, but where the next sequential step after folding has been accomplished (FIG. 2) wherein the folding or turnunder is completed and the forming fingers are disposed horizontally;

FIG. 3*a* is a view taken along the line 3*a*—3*a* of FIG. 3;

Figure 5A:
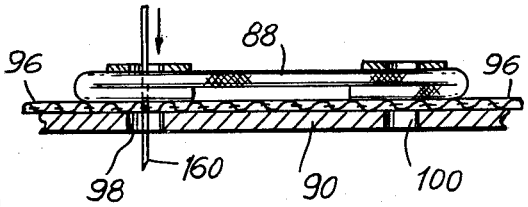
FIG. 5 is a view of the station shown in FIGS. 2–4, but wherein the inserter is shown in broken line as having retracted from the position shown in FIG. 4 and in full line returning to its upright position, and wherein the sewing operation is in progress.
Figure 5:
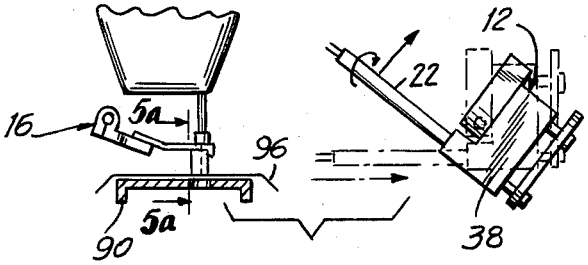
Figure 6:
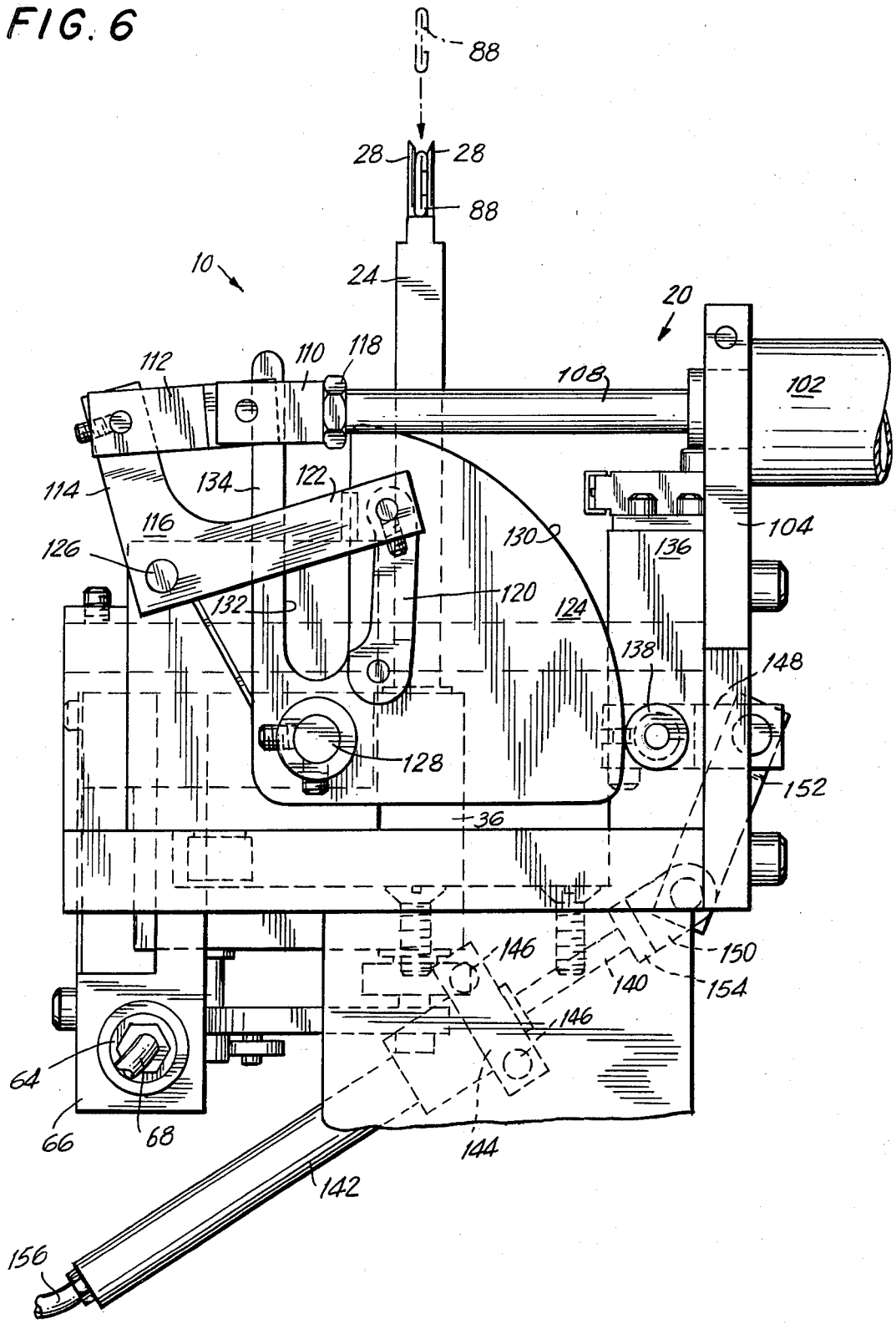
Figure 7:
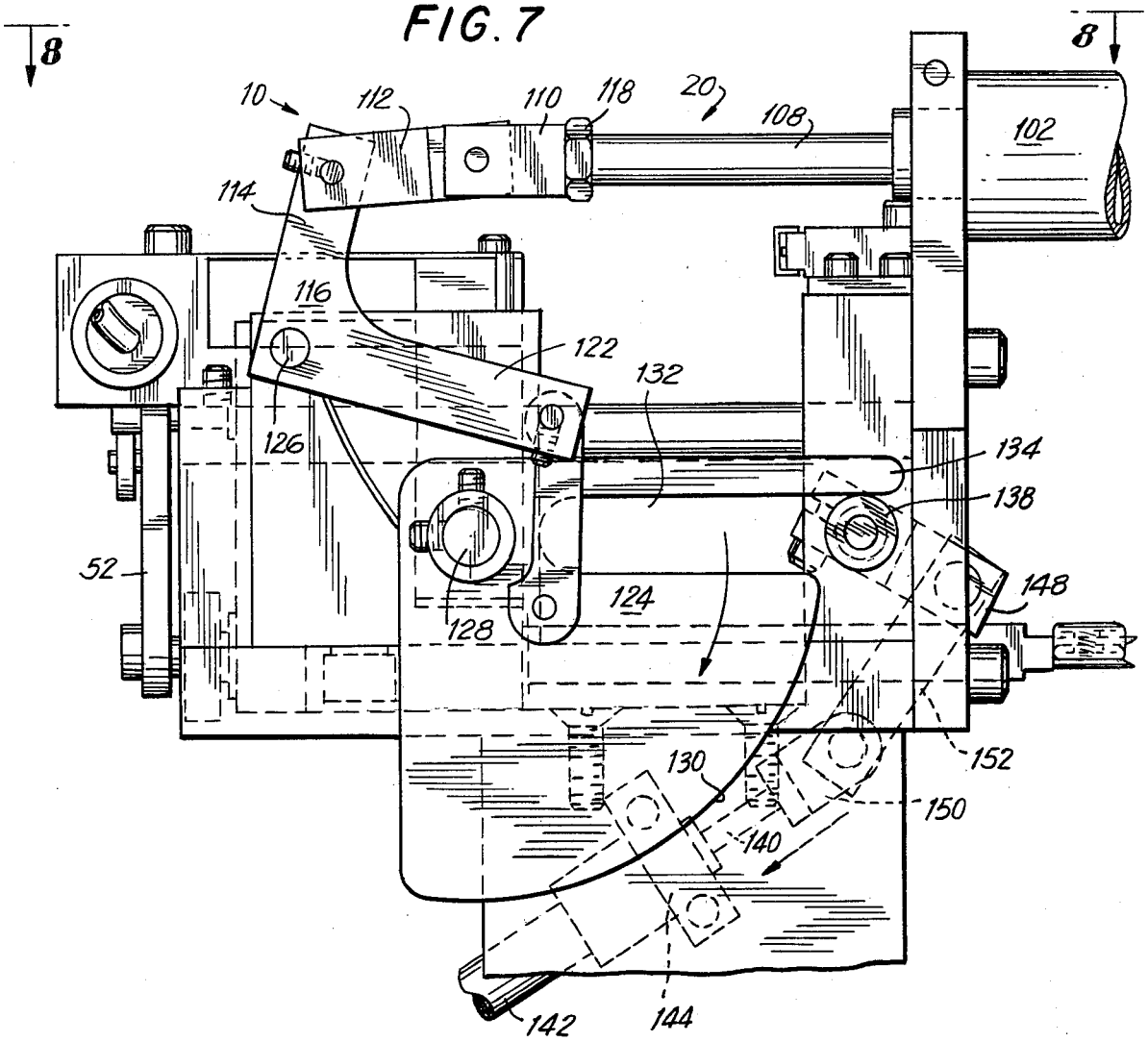
Figure 9:
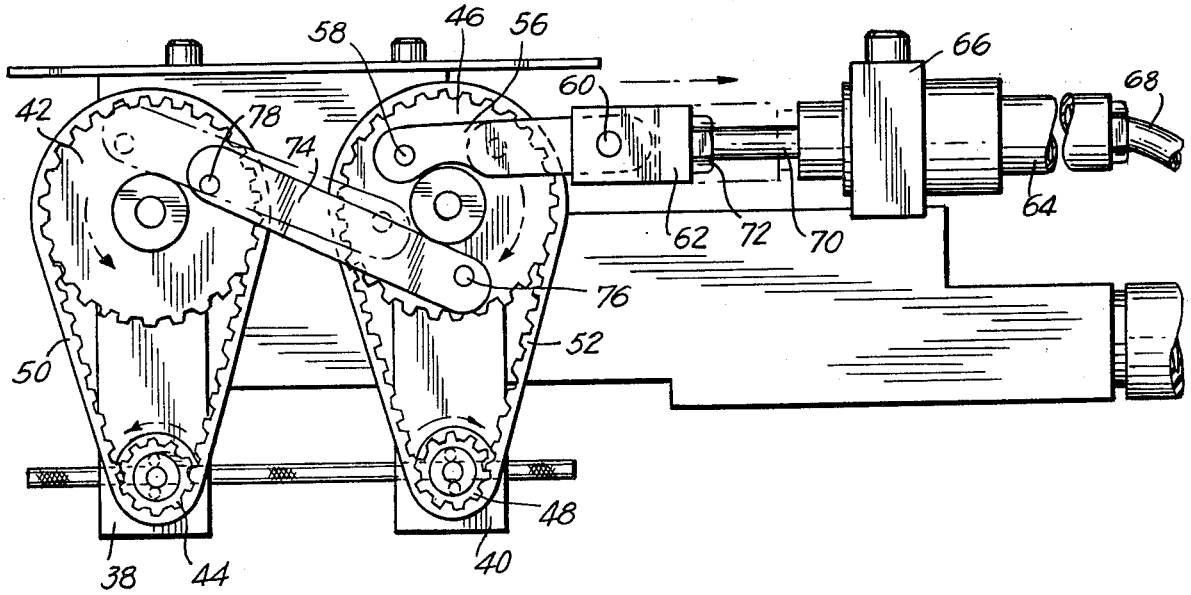
Figure 8:
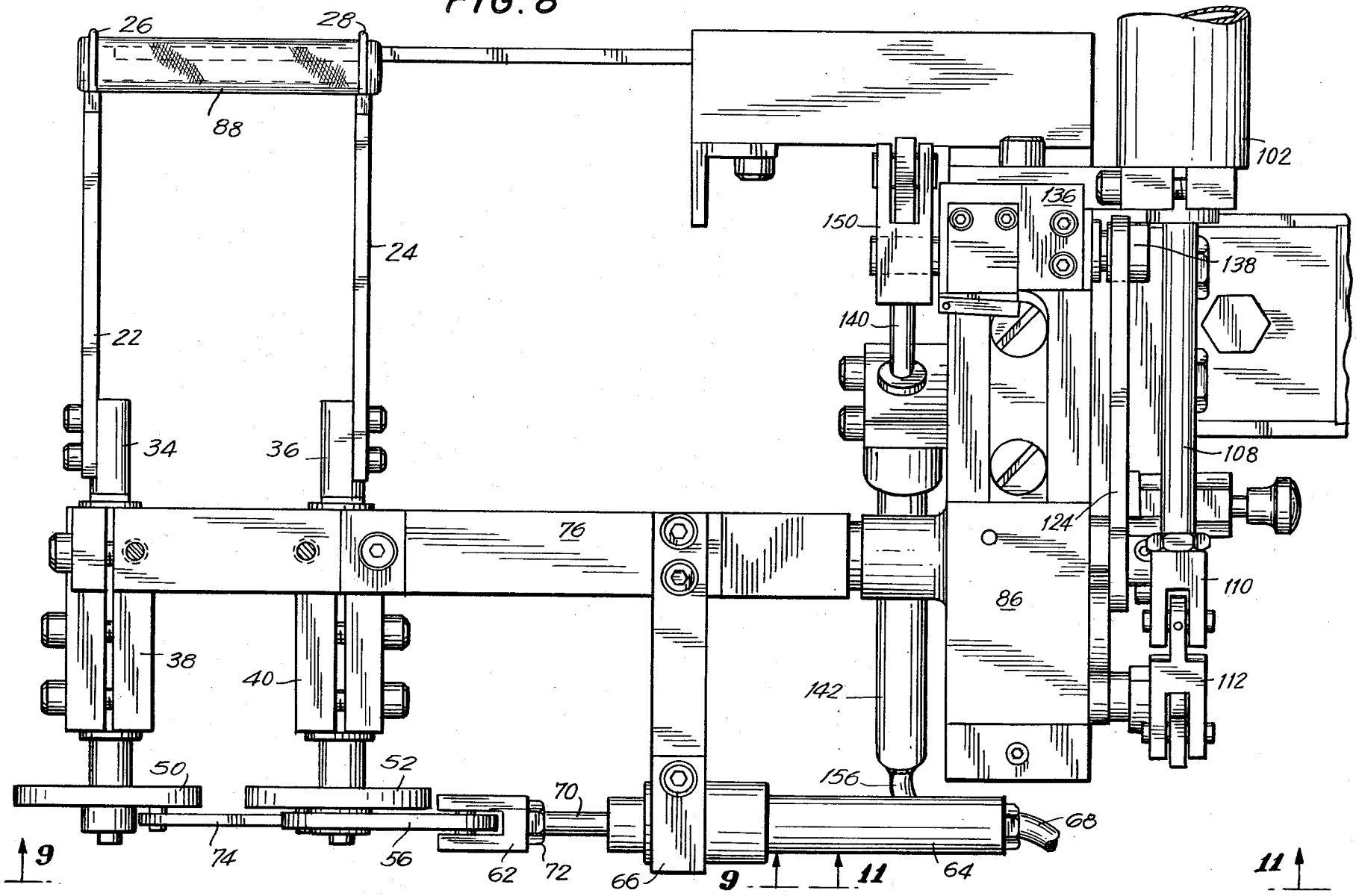
Figure 10:
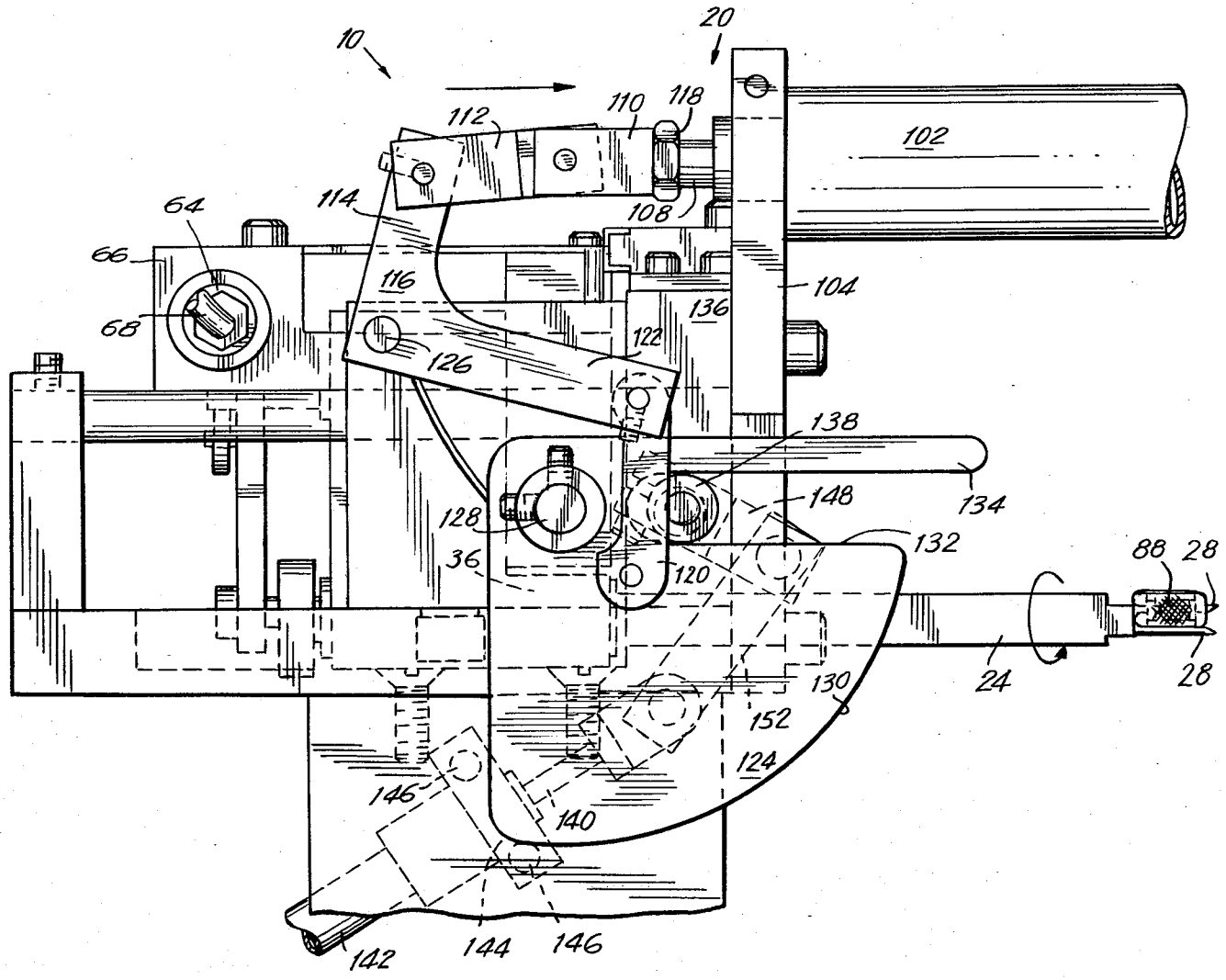
Figure 11:
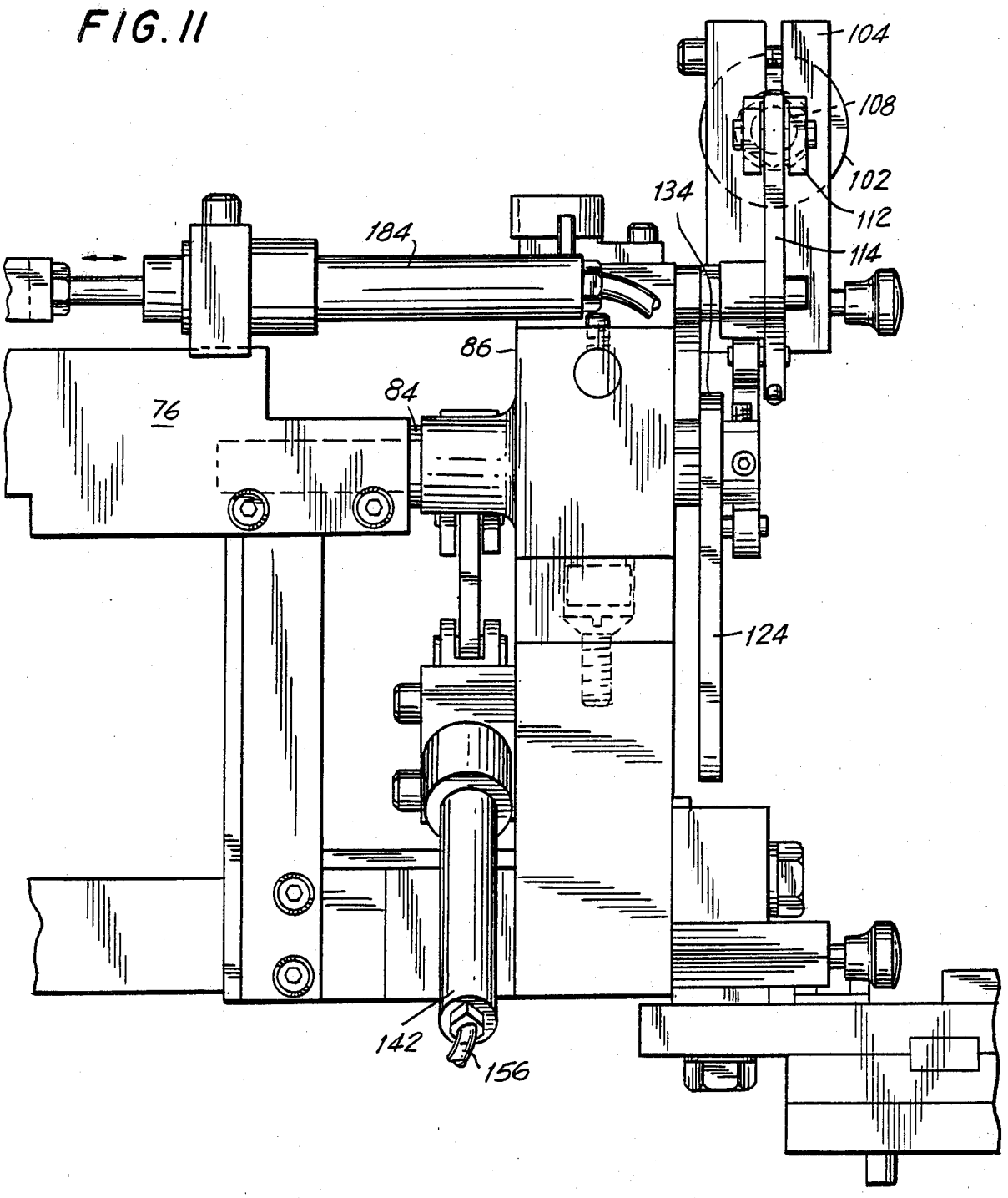
Figures 12, 13:
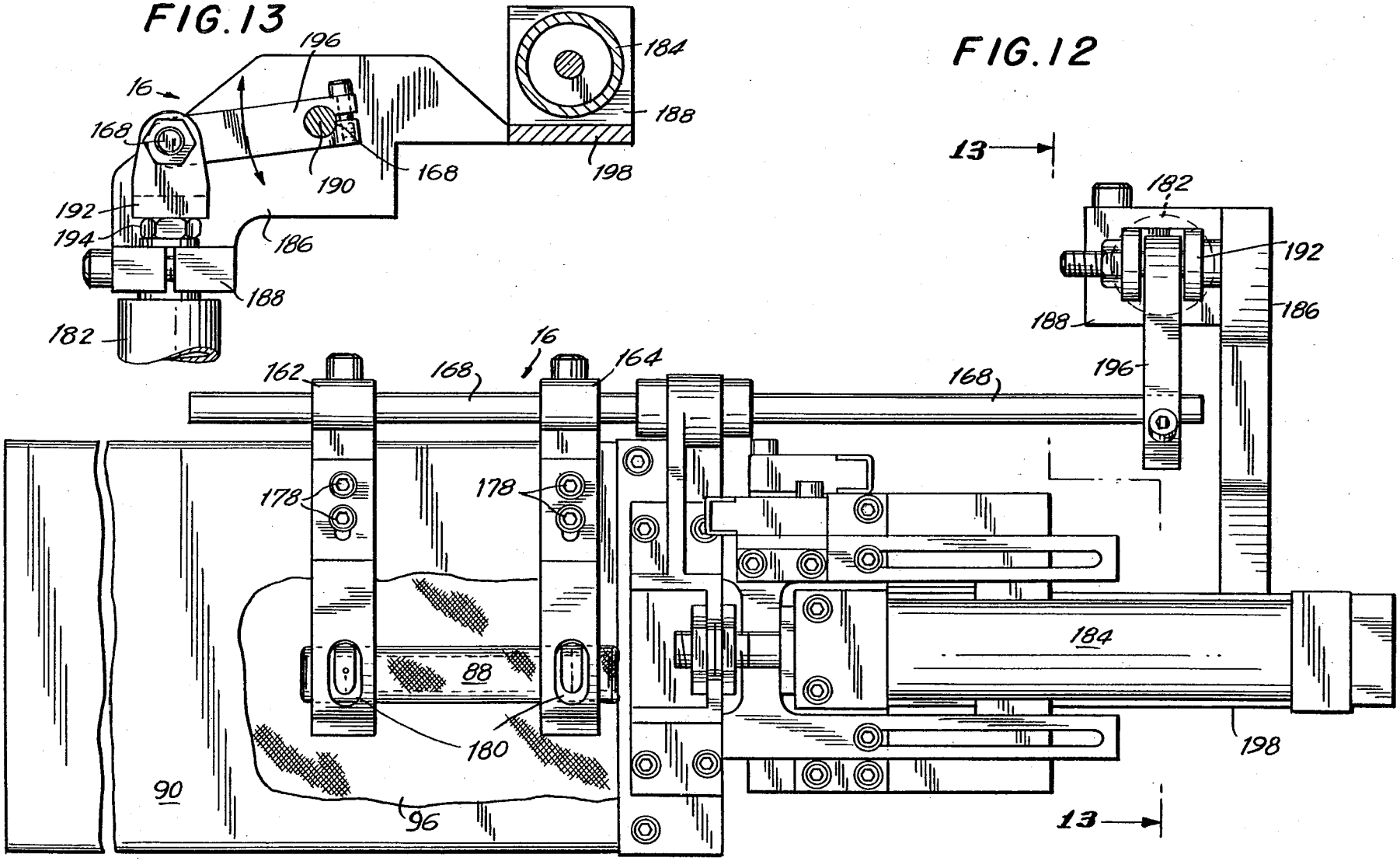

FIG. 5*a* is a view taken along the line 5*a*—5*a* of FIG. 5;

FIG. 6 is a view taken along the line 6—6 of FIG. 1;

FIG. 7 is a fragmentary side elevational view of the belt setting system shown in FIG. 1;

FIG. 8 is a view taken along the line 8—8 of FIG. 7;

FIG. 9 is a view taken along the line 9—9 of FIG. 8;

FIG. 10 is a view similar to FIG. 6 during another stage of the sequence of operations to be described below;

FIG. 11 is a view taken along the line 11—11 of FIG. 8;

FIG. 12 is a view taken along the line 12—12 of FIG. 1;

FIG. 13 is a view taken along the line 13—13 of FIG. 12.

Referring now in more detail to the drawings, we wish to emphasize here that an effort has been made to depict in the drawings a number of components and mechanical parts that are unnecessary to detail here in this specification in order to describe what we believe to be the principal features of the invention. For this reason, an effort will be made to avoid burdening this specification with unnecessary reference characters and unnecessary descriptions that may be more appropriate for a technical manual. However, we wish to emphasize here that a sufficient disclosure and specification shall be set forth so as to enable one skilled in this art to practice the claimed invention.

FIG. 1 is a perspective type of view illustrating an overhead view of portions of the system of the present invention which may be said to include a semi-automatic apparatus and method for folding, positioning and tacking both ends of a belt loop on a trouser waistband, for example. It should be said at the outset that an optional foot pedal allows the operator to bar tack the upper end of a front pocket, as well as to accomplish the other steps that will be set forth. The overall system, designated reference character 10, utilizes pre-cut presewn belt loops which are loaded by the operator while the machine to which the attachment is secured is sewing. This invention contemplates not only provision for an attachment for existing commercial sewing machines, but an entire system which includes the sewing operation and sewing equipment itself, as well.

For the convenience of the reader, this patent specification will describe the apparatus making up system 10 in terms of sub-assemblies which include components that are grouped more from a functional standpoint than from a manufacturing standpoint. Accordingly, a loop-forming sub-assembly 12 cooperates with a clamp or clamping sub-assembly 16, a feed plate/shifter sub-assembly 18, and an inserting mechanism or sub-assembly 20.

The loop-forming sub-assembly 12 comprises an interesting and novel means by which individual pre-cut strips of belt loop material are held, manipulated, and released. More specifically, a pair of finger members or fingers 22 and 24 are shown in FIGS. 1 and 1*a* initially in an upstanding position, and terminating at their respective upper ends in pairs of pins 26 and 28. Each of the pairs of pins 26 and 28 are spaced a pre-selected distance from one another, with an elongated slot 30 being formed in the extremity of each of the fingers 22 and 24. The combination of slots 30 and adjusting screws 32 associated with each of the fingers 22 and 24, enable an adjustment of the spacing between each of the pairs of pins associated with each finger.

Fingers 24 and 26 are, respectively, held by conventional type fasteners to posts 34 and 36 which, in turn, are journalled in and supported by finger base members 38 and 40.

Each of finger base members 38 and 40, respectively, supports larger and smaller sprocket wheels 42/44 and 46/48. Sprocket wheels 42 and 44 are cooperatively interconnected by sprocket chain 50, while sprocket wheels 46 and 48 are cooperatively interconnected by sprocket chain 52. The ratio of sprocket wheel diameters is pre-selected for purposes of obtaining desired gear ratios, and chain tension clamp screws 54 facilitate adjustment of tension within sprocket chains 50 and 52.

As perhaps best seen in FIG. 9, rotation of sprocket wheel 46 is induced by means of a drive link 56 through a pin connection 58 at one end of drive link 56, and the opposite end of link 56 terminating in a clevis pin connection 60. Reciprocatory movement of clevis 62 and its clevis pin 60 causes like movement of drive link 56, and is caused by means of logical programmed pneumatic circuitry feeding a twirl cylinder 64 shown in FIG. 9.

A forward end of twirl cylinder 64 is removably held within slotted and adjustable depending support block 66, and is shown in FIGS. 1 and 9 with a portion of its air supply line 68 extending from its rear. A plunger 70 which is integrally connected with the internal piston of twirl cylinder 64 is joined with clevis 62 by means of a lock nut 72.

A sprocket connecting link 74 interconnects larger sprocket wheels 42 and 46 via pin connections 76 and 78 such that, upon retraction of plunger 70 through twirl cylinder 64 from the position of clevis 62 shown in full-line to that of broken or phantom outline shown in FIG. 9, drive link 56 will likewise move, thereby causing rotation of sprocket wheel 46 and comparable rotation of sprocket wheel 42 by means of sprocket connecting link 74. Sprocket chains 50 and 52 transmit this rotary motion to smaller sprocket wheels 44 and 48 such that, through rotation of posts 34 and 36, fingers 22 and 24 are caused to rotate in opposite directions in an articulation about an artificial center of rotation offset with respect to the center line of posts 34 and 36.

As seen in FIGS. 1 and 9, a horizontally extending support bar 76 supports not only lock 66 by means of fasteners 78, but also finger base members 38 and 40 by means of rods 80 and 82 at points near its remote end opposite its cylindrical end 84 which, in turn, is supported for rotation via its extension through stationary upstanding rectangular column 86. The functional relationship between the endmost portion of bar end 84 and an insert cam and an insert cylinder is described within this specification at a later point below. Suffice it to say at this point, horizontal support bar 76 is rotatable about the axis of its end 84 such that the entire loop-forming subassembly is thereby caused to rotate about this same axis, independent of the rotation of fingers 22 and 24.

At this point in this patent specification, it is desirable to describe the formation of a belt loop from a strip of belt loop material herein designated by reference character 88, and shown within FIGS. 1, 1*a*, et seq. When the system 10 is in operation, a machine operator places a strip 88 of belt loop material between the pair of pins 26 and 28 such that strip 88 is positioned in the manner shown in FIG. 1. Fingers 22 and 24 will remain in their upstanding, loop-receiving position shown in FIG. 1 until the operational sequence described in more detail below is commenced.

At this point in the specification, it is perhaps best to now describe the actual formation of a belt loop by means of twirling pins 26 and 28. Before doing so, however, it must once again be emphasized here that the apparatus of the present invention does *not* utilize pins which are caused to rotate about the center of one of the pins, or about a point between the pins. If this is attempted, a relatively large torque is developed because the material being formed must slip with respect to the pins as they twirl, thereby causing a large increase in friction as the material wraps around the pins. In the case of forming a fell or undertuck of belt loop material for positioning and fastening to a pair of trousers, this torque is considerable and will bend the loop-forming pins as well as cause an undesirable binding. This results in pulling the two sets of pins together and, in some cases, will cause actual inelastic bending of these pins.

Figure 2:
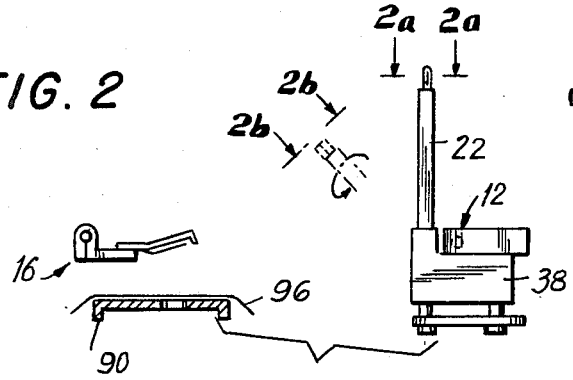
Figure 2A:
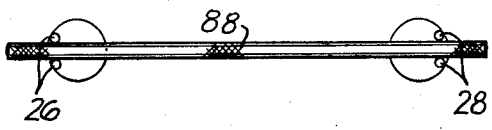
Figure 2B:
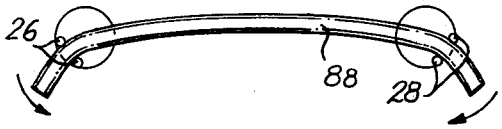
Figure 3:
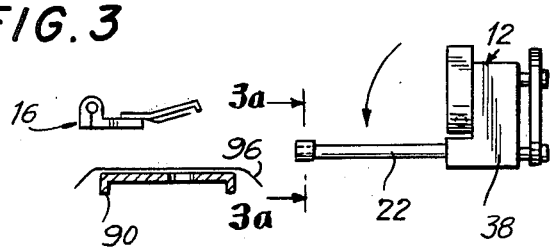
Figure 3A:
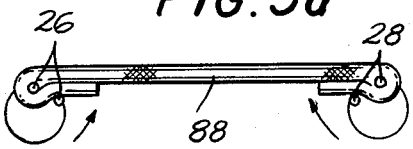

The present invention by utilizing centers of rotation with respect to the pairs of pins 26 and 28 shown in FIGS. 2*a*, 2*b* and 3*a*, overcomes these limitations by actually facilitating the formation of a belt loop from a strip of pre-cut belt loop material, *without* slipping of the material with respect to the pairs of pins being at all necessary. In fact, according to the present invention, a slack is created in the belt loop strip and only after the fell or undertucking is created is the material extending between the pairs of pins brought to a taut condition.

Referring now in more detail to the drawings, FIGS. 2*a*, 2*b* and 3*a* illustrate, respectively, the beginning, and intermediary point, and the completion of the pin twirling and loop-forming sequence that is accomplished just prior to the sewing of the completed loop to trouser material, as an example, as best illustrated in fragmentary sectional view FIG. 5*a*. In FIG. 2*a*, it can be seen that the pairs of pins 26 and 28 move in opposite fashion such that the right and left sides of FIGS. 2*a*, 2*b* and 3*a* are substantially mirror images of the opposite sides. Center lines have been used within these views not only to illustrate the fact that the center of rotation of each pair of pins is offset from the pins themselves and any point between them, but also to give the reader a better understanding of the positioning of the pins with respect to these centers of rotation when the belt loop material is in the configurations shown at each of these steps during the approximate 270° angle of rotation of the pins about their artificial centers.

In FIG. 2*a*, pins 26 and 28 are shown with their mid point at approximately nine o'clock and three o'clock, respectively, at a time when the belt loop material 88 is inserted between the pins. Upon actuation of twirl cylinder 64 described above, rotation of fingers 22 and 24 result in their respective pairs of pins 26 and 28 rotating oppositely with respect to one another and toward one another to create a slack in belt loop material 88 (FIG. 2*b*) while the fell or tuck is being formed. Continued rotation of the pairs of pins 26 and 28 about their centers culminates in the tuck being formed (FIG. 3*a*), and with the material 88 being drawn to a substantially taut condition, and wherein one of each of the pairs of pins 26 and 28 comes to rest at a substantially tangential twelve o'clock position with respect to its artificial center of rotation.

In a preferred embodiment of the present invention, the twirling and folding of the belt loop material into belt loop form is accomplished during rotation of the loop-forming sub-assembly 12 and the insertion of the formed belt loop into its sewing position on trousers which have been positioned on top of a feed plate 90 (FIG. 1).

Means are provided for adjustment not only of the offset of the pairs of pins 26 and 28 with respect to their centers of rotation, but also the magnitude of the angle of rotation. This enables the user to accommodate different thicknesses of belt loop material and enables the user to accomplish different kinds and types of bend configurations, if desired. The type of bend illustrated in the drawings represents a preferred embodiment.

Mention has been made of a feed plate 90. At this point we wish to affirm that the present invention comprising the system 10 herein described contemplates a system wherein a sewing machine and its associated components are provided, as well as an attachment system capable of being fitted on and to an existing sewing machine purchased separately from the present invention. However, the novel advance provided by the present invention is such that we believe our protection and any possible royalty income should contemplate in some instances the value of the entire system and sewing machine and apparatus when making computations. One of the reasons for this position resides in our belief that conventional or known sewing machines and apparatus are unable to provide the benefits herein described for the present invention.

FIG. 1 illustrates a sewing machine 92 of a basic structural type available from manufacturers such as Singer and Union Special. A suitable starting paddle 94 or lever or, for that matter, a foot pedal/chain arrangement, may be used by the operator to start the inventive sequence.

When the procedure is complete, a folded and tucked belt loop will have been sewn to the top of a pair of trousers or trouser material 96, as an example (FIG. 1), which have been positioned by the operator on top of feed plate 90 which includes a pair of needle clearance slots or holes 98 and 100, which are formed through the feed plate.

In operation, the present invention not only provides the formation of a belt loop, as described above, but also provides reliable and repeated positioning of belt loop material in a position to be sewn. This is accomplished with the cooperative help of inserting sub-assembly 20.

Referring now to FIG. 6, which illustrates system 10 in a loading position, wherein material 88 is shown in phantom outline prior to loading and in loaded position between the pins of fingers 22 and 24 (finger 24 obstructs the view of finger 22 in FIG. 6), a pneumatic insert cylinder 102 is shown (see also FIG. 1) with its operative end held and positioned by means of upstanding support block 104. Insert cylinder 102 is operatively connected by means of its air line 106 to the pneumatic circuitry referred to for twirl cylinder 64 above. An associated plunger member 108 which is integrally connected to or may form part of an internal piston (not shown) associated with insert cylinder 102 extends outwardly from cylinder 102 and support block 104 toward and to a clevis linkage arrangement comprising clevis members 110 and 112 which, via pin connections, link arm 114 of lever 116 with plunger 108. A lock nut 118 removably secures this connection.

A connecting link 120 interconnects arm 122 of lever 116 via pin-type connections with an insert cam 124. Insert cam 124, like lever 116 at journal point 126, is supported for rotation with respect to column 86 at journal point 128. Cam 124 includes an arcuate cam bearing surface 130 which basically comprises a radius about journal point 128, and an elongated substantially radial slot 132 bounded at its leftmost side as shown in FIG. 6 by finger portion 134.

Support column 136, which is stationary and preferably integral with column 86, supports a cam roller follower 138 shown in FIGS. 6, 7, 8 and 10. The outer cylindrical surfaces of cam roller follower 138 engage arcuate cam bearing surface 130 of insert cam 124. Slot 132 is of dimensions that enable the entry therein of cam roller follower 138 and engagement of the outer surfaces of follower 138 with the surfaces which define slot 132, as will be seen below.

A linkage arrangement interconnects follower 138 with the plunger 140 of a duck cylinder 142. The operative end of duck cylinder 142 is supported by means of support block 144, which is positioned by means of fasteners 146 to the base of column 136. Clevises 148 and 150 are interconnected by a connecting link 152, thereby causing cooperation between roller follower 138 and the lock nut 154 end of plunger 140 associated with duck cylinder 142.

Duck cylinder 142, like insert cylinder 102 and twirl cylinder 64, is interconnected by means of air line 156 to the pneumatic circuitry associated with system 10.

In operation, the inserting sub-assembly 20 cooperates with the loop-forming sub-assembly 12 as follows. Referring to FIGS. 6, 7 and 10 in particular, insert cylinder 102 is actuated such that its associated plunger 108 is drawn toward the cylinder. This results in a forceful pivoting of lever 116 through its arm 114 and the linkage involving clevises 110 and 112 revolving about pivot or journal point 126. This, in turn, results in rotation of insert cam 124 about its pivot or journal point 128 as a result of the forceful eccentric urging through arm 122, rotates from the position shown in FIG. 6 to the intermediary position shown in FIG. 7, with cam roller follower 138 following the cam surface 130 of cam 124 during this rotation in a clockwise direction.

Once cam 124 has reached the substantially 90° from that shown in FIG. 6, the interfering following cam surface presence of surface 130 no longer inhibits or interferes with movement of the cam 124 in the general direction (forward) of cylinder 102. Upon further urging of plunger 108, cam 124 advances such that cam roller follower 138 enters slot 132 and advances until the sub-assembly assumes the position best seen in FIG. 10, wherein plunger 108 is substantially fully retracted.

Figure 4:
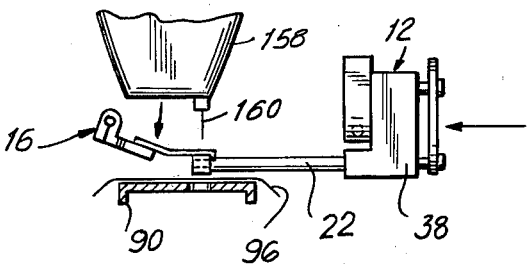
FIG. 4 is a view of the station similar to that of FIGS. 2 and 3, but where the inserter has advanced the forming fingers to a position beneath the stripper/clamp and over the work.

This sequence of operation of inserting sub-assembly 120 accomplishes the function of rotating the loop-forming sub-assembly 112 from the position shown in full-line in FIG. 2 first to the intermediary position shown in phantom or broken lines shown in FIG. 2 and thereafter to the position shown in FIG. 3, wherein the fingers 22 and 24 that are holding the belt loop that has been formed during this sequence are substantially horizontal and at an elevation slightly above that of the trouser material to which the belt loop is to be sewn. Thereafter the fingers are advanced over the trouser material and, upon actuation of duck cylinder 142 and through the linkage described, the loop is dropped while being held such that it is correctly positioned in contact with the trouser material. This is best seen in FIG. 4.

For a better understanding of the relative positions of these components, FIG. 2 illustrates the loop-forming sub-assembly in a position corresponding to the apparatus position illustrated by FIG. 6. FIG. 3 illustrates this apparatus in the position corresponding to that shown in FIG. 7, wherein it will now be appreciated that cam 124 is integral with the loop-forming sub-assembly 12 such that its rotation results in rotation of sub-assembly 12. FIG. 4, which illustrates the advancing of loop-forming sub-assembly 12 in the direction of the sewing head 158 of sewing machine 92 and its needle 160 corresponds to the positioning illustrated within FIG. 10.

Before going on to describe the clamping, sewing, and shifting mechanisms, the sequence of operation of the inserting sub-assembly 20 just described, once the clamping, sewing and shifting is accomplished, is simply reversed by means of the pneumatic circuitry logic that has been preprogrammed. This is best illustrated within the right portion of FIG. 5 of the drawings.

Having just described the means by which the belt loop strip material has been formed into a loop by means of loopforming sub-assembly 12, and having described the means by which this loop is rotated from the position at which it has been inserted between the pins of fingers 22 and 24 to the sewing position, we turn now to the means by which the belt loop is clamped and held reliably in the sewing position as well as the means by which the material being held is shifted between the two positions or stations at which sewing of the belt loop to the trouser material occurs.

As best seen in FIG. 1 and top plan view 12, clamp or clamping sub-assembly 16 includes a pair of movable clamp holders 162 and 164 which are positioned on and supported by a horizontally extending support rod 168. Clamp holders 162 and 164, respectively, support outer clamps 170 and 172 as well as clamp leaf springs 174 and 176 situated in spaced relationship beneath each outer clamp 170 and 172. These outer clamps 170 and 172, as well as the leaf springs 174 and 176 are secured to the clamp holders 162 and 164 by means of cap screws 178. Needle clearance holes 180 are formed through each of the outer clamps 170 and 172.

A clamping cylinder 182 of the pneumatic type and tied to the same pneumatic programmed circuitry already described for twirl cylinder 64, insert cylinder 102, duck cylinder and soon to be described shift cylinder 184, is vertically positioned and held by means of an angled bracket 186 formed with clamping boss 188. The support rod 168 is caused to be pivoted about point 190 by means of cylinder 182 through a linkage made up of clevis 192 to which the plunger (not shown) associated with clamp cylinder 182 is secured by means of lock nut 194, and a link member 196. This is best seen in enlarged elevation view FIG. 13.

The same bracket 186 whose boss 188 holds clamping cylinder 182 is formed with a substantially horizontal shelf portion 198. As seen in FIGS. 1 and 13, this shelf 198 supports shift cylinder 184 which is situated horizontally with respect to system 10. A plunger 200 is associated with shift cylinder 184 in much the same manner as has been described for plunger 108 associated with insert cylinder 102. Feed plate 90 is secured to the end of plunger 200 through a bracket 202 and fastening means 204. Feed plate 90 is supported for sliding movement over guide support rail 206. Further guiding is accomplished by means of sleeve 208 slidably supported upon support rod 168.

In operation, clamp sub-assembly 16 operates as follows. Actuation of clamp cylinder 182 results in a lowering of support rod 168 and thus clamps 170 and 172 with their associated leaf springs 174 and 176. This results in a clamping or holding of the formed belt loop 88 to and in contact with the trouser material 96. This position may be seen in FIG. 4. At this point the sewing head operates such that the sewing needle is able to pierce and tack or sew the upper connection of the belt loop 88 to the trousers. After the sewing or tacking of this upper tack is completed and the needle 160 retracted, shift cylinder 184 is actuated such that its plunger 200 is retracted, thereby drawing feed plate 90 and the clamped material and trouser material toward cylinder 184 until needle clearance hole 100 lies beneath needle 160. Thereupon, the second sewing operation is accomplished and the needle retracted.

To summarize again, loop-forming sub-assembly 12 receives belt loop material 88, forms this material into a belt loop and holds it in this position ready for sewing. Inserting sub-assembly 20 rotates loop-forming sub-assembly 12 and draws it horizontally and then downwardly over the trousers to the sewing position at which the belt loop material 88 is to be secured by two tacks to the trouser material. Clamp sub-assembly 16 draws the formed belt loop and holds it against the trouser material at all times during the sewing operation. The shifting sub-assembly 18 utilizing shift cylinder 184 moves the feed plate and the entire clamped sub-assembly 16 between two sewing stations.

After the sewing is accomplished, all of these sub-assemblies return to their initial positions in order to receive another strip of belt loop material and in order to accomplish on a repetitive basis the same sequence of operations. This is at least partially illustrated in the case of loop-forming sub-assembly 12 within FIG. 5.

The system 10 which is commercially referred to as a belt loop setter, now according to the present invention provides a new and automated approach to fastening belt loops to jeans and leisure trousers. The most time-consuming part of the operation is automated, and efficient reliable repeatability is accomplished. Essential features of system 10 include a 3.2 second loop attachment cycle, including the folding, placement and the two tacks; the provision of relatively unskilled labor requirements in order to operate the system; automatic folding, positioning and tacking of the ends of each loop; minimum holdunder for neat appearance after washing; the use of pre-cut loops, thereby enabling retention of shade matching control; and installation of seven loops in less than one minute, inclusive of trouser positioning and loading. The system provides all of these features with all-pneumatic logic and operation, with high reliability components, low air consumption, and no electronics.

This system further provides a training cycle, a normal cycle, and an optional auxiliary clamping cycle. Adjustability of virtually all sub-assemblies and components is provided.

Other options that will be briefly touched upon here include a training cycle, whereupon an inexperienced operator is able to stop the operation of system 10 at any point before sewing beings, so that errors in positioning the waistband of the trouser material or errors in placing the loop in the twirl pins can be corrected. When the training mode switch (not specifically described here) is in the "train" position, the cycle is the same as normal operation except that the start paddle 94 will be held in the operated position until sewing starts. When sewing begins, the cycle continues automatically to the end. If the start paddle is released at any point before sewing starts, the machine will return to the start position. The training cycle can be used as an alternate to the normal cycle permanently if desired.

A special tack option is provided with the present invention, whereupon the operator positions the top of a pocket under the outer clamp and depresses the foot switch. The clamps come down, the feed plate shifts to the second tack position and sewing begins. When the tack is complete, the feed plate shifts out and the clamps lift. There is no belt loop insertion when the foot pedal is used. The special tack may be operated at any time between the normal belt loop cycles.

Another option includes a "clamp down" switch, whereupon the clamp down switch lowers the clamps to facilitate needle threading and certain adjustments. When this switch is operated, the air is removed from the rest of the mechanism and the mechanism can be operated manually.

Another option provided includes a sew test button which will cause a sew cycle if it is pressed when the "clamp down" switch is operated. This allows the sewing machine to be checked without going through a complete loop setting cycle.

Another option includes a loop tack repair, such as in the case where if the upper tack is unsatisfactory, the loop should be cut off and replaced. If the lower tack is unsatisfactory or missed because of thread break of bobbin runout, it can be repaired in place if the machine is equipped with a special tack option. By removing the partial tack if necessary, the user folds the loop manually under the clamp. The clamp is then pushed down with the left hand and the special tack foot pedal is pressed. When the feed plate begins to shift, the left hand is removed from the clamp which is now under power operation.

It must again be emphasized here that the user of system 10 is able to alter loop lengths, loop tension and loop thicknesses. More specifically, to change the loop length, a different feed plate 90 with sewing openings that correspond to the distance between the tacks is substituted for the prior plate. The new plate is fastened with two screws at its inner end. The form fingers 22 and 24 are adjusted to correspond to the sewing slots. The pins are adjusted such that the center distance is the same as the sewing slot spacing, while maintaining the pin attitude. The tilt of the pin assemblies is usually about the same.

In the case of altering the loop tension, this is accomplished by adjusting the stroke of the twirl cylinder 64. To reduce tension, the piston rod or plunger lock nut is manipulated. In the case of differing loop thicknesses, the twirl pin spacing is adjusted with screws 32.

The embodiments of the present invention particularly disclosed are presented merely as examples of the invention. Other embodiments, forms and modifications of the invention coming within the proper scope of the appended claims will, of course, readily suggest themselves to those skilled in the art.

What is claimed is:

1. A loop setting system comprising, in combination: a first pair of pin members extending substantially in a first direction a predetermined distance from a first reference axis, a second pair of pin members spaced from said first pair of pin members and extending substantially parallel with respect to said first direction a predetermined distance from a second reference axis, said first and second pairs of pin members each defining respective first and second slots therebetween capable of receiving therein relatively remote portions of material to be manipulated to form a folded configuration capable of joinder with other material, means for arcuately moving said first and second pairs of pin members about said respective first and second axes, thereby accomplishing said folding manipulation and positioning the formed configuration with respect to a reference plane, said first pair of pin members being disposed such that all points along a line joining said first pair of pin members are spaced a pre-determined distance from said first axis, said system further comprising means for arcuately moving said pin members about an axis substantially perpendicular with respect to said first axis to a joining position, means for withdrawing said pin members from the material prior to a step of joining, means for joining said material to other material, and means for causing a return of said pin members to their original position.

2. A method of repeatedly forming loop-like configurations incorporating lengths of material such as, without limitation, folded belt loop segments to be joined to apparel, or the like, comprising the steps of: receiving relatively remote portions of a length of material within a pair of first and second spaced pairs of pin members, rotating said first and second pairs of pin members about first and second axes which are, respectively, disposed a pre-determined distance from all points along a line joining respective pin members of each said pin, said step of rotating causing a folding of at least one end of said material backwardly upon itself, said method further comprising the steps of arcuately moving said pin members about an axis substantially perpendicular with respect to said first axis to a joining position, withdrawing said pin members from the material prior to a step of joining, joining said material to other material, and causing a return of said pin members to their original position.

* * * * *